US009895278B2

(12) United States Patent
Socha

(10) Patent No.: US 9,895,278 B2
(45) Date of Patent: Feb. 20, 2018

(54) ENVIRONMENT-FRIENDLY COFFIN

(71) Applicant: SOCHA PIOTR ZAKŁAD KAMIENIARSKI, Łańcut (PL)

(72) Inventor: Piotr Socha, Łańcut (PL)

(73) Assignee: SOCHA PIOTR ZAKLAD KAMIENIARSKI, Lancut (PL)

( * ) Notice: Subject to any disclaimer, the term of this patent is extended or adjusted under 35 U.S.C. 154(b) by 0 days.

(21) Appl. No.: 15/123,767

(22) PCT Filed: Mar. 5, 2015

(86) PCT No.: PCT/PL2015/000040
§ 371 (c)(1),
(2) Date: Sep. 6, 2016

(87) PCT Pub. No.: WO2015/133918
PCT Pub. Date: Sep. 11, 2015

(65) Prior Publication Data

US 2017/0014293 A1 Jan. 19, 2017

(30) Foreign Application Priority Data

Mar. 7, 2014 (PL) ..... P.407425
Dec. 29, 2014 (PL) ..... P.410785

(51) Int. Cl.
*A61G 17/007* (2006.01)
*A61G 17/04* (2006.01)
*A61G 17/02* (2006.01)

(52) U.S. Cl.
CPC ..... *A61G 17/007* (2013.01); *A61G 17/02* (2013.01); *A61G 17/04* (2013.01); *A61G 17/041* (2016.11)

(58) Field of Classification Search
CPC .... A61G 17/007; A61G 17/041; A61G 17/02; A61G 2203/90; A61G 17/04
(Continued)

(56) References Cited

U.S. PATENT DOCUMENTS 11,166 A * 6/1854 Lyeth ..... A61G 17/008 27/2
19,503 A * 3/1858 Hooker ..... A61G 17/00 27/3

(Continued)

FOREIGN PATENT DOCUMENTS

CN 2031 39025 U 8/2013
GB 2487444 A * 7/2012 ..... A61G 17/04

(Continued)

*Primary Examiner* — William Miller
(74) *Attorney, Agent, or Firm* — Horst M. Kasper, Esq

(57) ABSTRACT

The environment-friendly coffin according to the invention comprising a box assembly and a profiled lid assembly covering said box assemblies, with both assemblies being connected to each other by means of connecting elements, is characterized in that the coffin's box assembly (1) comprises a casing (3) made of natural stone plates, plate-shaped flats (10) with tapped bores (11) made in them, fixed to inner or outer surfaces of longer plate side walls (5) of said casing, plate-shaped metal washers (12) with tapped mounting bores (13) fixed to these inner side walls (5) and a tubular element (15) mounted inside casing (3), said element tubular being made of glass fiber mat or metal and fastened to inner surfaces of plate side walls (5) and to bottom (4) made of natural stone slab or made of natural stone slab and plate (27) made of a made of a wood-base material and fixed to said stone slab by means of glue-based sealing mass (17), whereas the profiled lid assembly (2) of the coffin has an outer casing made of natural stone in the form of a solid with bottom cascade-shaped cavity (23) or with trough-shaped cavity (32) with a profile of the truncated pyramid, with a lower side offset in the form of a slab frame (29), where in the inner surface of said casing there is insert (30) made of a wood-base material with the same profile fixed by means of a glue to which glass fiber mat (31) is glued.

6 Claims, 16 Drawing Sheets

(58) Field of Classification Search
USPC ..... 27/2, 3, 14, 19, 27
See application file for complete search history.

(56) References Cited

U.S. PATENT DOCUMENTS

| | | | | | |
|---|---|---|---|---|---|
| 1,634,767 | A * | 7/1927 | Barron | A61G 17/00 | 27/3 |
| 4,209,880 | A * | 7/1980 | Lidholm | A61G 17/00 | 27/2 |
| 5,507,070 | A * | 4/1996 | Spyche, Jr. | A61G 17/02 | 16/49 |
| 5,964,014 | A * | 10/1999 | Wang | A61G 17/00 | 27/10 |
| 6,145,175 | A * | 11/2000 | Enneking | B65D 5/68 | 27/19 |
| 8,601,653 | B1 * | 12/2013 | Agurcia | A61G 17/007 | 27/2 |
| 2009/0188089 | A1 | 7/2009 | Xue | | |
| 2013/0042447 | A1 * | 2/2013 | Brownlow | A61G 17/00 | 27/14 |

FOREIGN PATENT DOCUMENTS

| | | | |
|---|---|---|---|
| PL | 399 618 | A1 | 12/2013 |
| PL | 12 11 75 | U1 | 1/2014 |

* cited by examiner

Detail "T"

Detail "S"

K-K

ENVIRONMENT-FRIENDLY COFFIN

CROSS-REFERENCE TO RELATED APPLICATIONS

The present patent application is a 35 U.S.C. 371 application from the international application no. PCT/PL2015/000040, filed on Mar. 5, 2015, claiming priority of the Polish patent applications nos. P.407425 and P.410785, whose content is incorporated in the present patent application by reference.

BACKGROUND OF THE INVENTION (1) Field of the Invention

The subject of the invention is an environment-friendly coffin, resistant to bio-degradation and preventing bacteria- and fungi-containing substances occurring as a result of decomposition of a human corpse from penetrating into soil and ground waters. The invention represents an improved modification of technical solution revealed in Polish patent application for invention P-407427.

(2) Description of Related Art Including Information Disclosed Under 37 CFR 1.97 and 1.98.

From Polish patent No. P-379949 known is a coffin, designed especially for cremation, having the structure of a coffin box and a coffin lid, comprising two and three spatial structural systems, whereas each of such structural systems is determined spatially with respect to the another structural system fitting tight to it Spatial systems of the coffin box and the coffin lid are connected with each other by means of joints in the form of grooves and tongues.

Known from description of Polish utility model No W-121175 and invention No P-399618 is also a coffin for fast self-assembly comprising a box and a top attached thereto, where the box comprises two side walls, two endwalls, and a bottom connecting them, while its lid comprises two side walls, two endwalls, and a cover. Side walls of the coffin's lid are connected with the two endwalls by means of metal I-section shaped connectors driven into milled seats, and the lid top is connected with said side walls and endwalls by means of an eccentric angle joint, whereas side walls of the coffin are connected with its endwalls by means of I-section shaped connectors, while bottom of the coffin is connected with side walls and endwalls of the box by means of metal I-section shaped connectors, and all walls of both the coffin box and the coffin lid are made of a lacquered furniture board.

Known also from description of a Polish industrial design Rp-10893 is a coffin made of organic glass designed for burying human corpses in tombs, having a frame skeleton welded out of metal angle section and walls made of inorganic transparent or dimmed glass mounted in the frame structure of said skeleton. The bottom of the coffin is lined with a wooden plate with a moisture-absorbing insert mounted in it, and two grip handles are attached to each of its longer glass walls.

Further, from patent descriptions CN203139025 and US2009188089A1 known is a glass coffin designed with the objective to extend the period of preserving a human corpse, with body of said coffin made of toughened glass and equipped with an air conditioning system maintaining temperature and humidity at a constant level. By using a toughened glass to fabricate the body of the coffin, the coffin prevents the corpse from decomposing extending thus the period for which the corpse is preserved.

An inconvenience characterising coffins known from the prior art made either of wood, wood-base materials, or glass, consists in that they allow the substances generated in the course of decomposition of a human corpse to permeate to soil and ground waters. An additional inconvenience of technical solutions used in environment-friendly coffins known to date consists also in difficulties related to lifting the heavy stone lid of the coffin up to open position and insufficient rigidity of the inner cuboidal element made of glass fibre mat.

For clarity, in the following there are explanations of meaning of some terms used in this patent description, namely:

- natural stone means also: granite, marble, quartzite, onyx, agglomerated marble, travertine, or natural stone veneer;
- glass fibre mat means also: kevlar-carbon fibre, roving fabrics, glass-fibre reinforced polyester sections
- a glue or a glue-based sealing mass means also: silicone, acrylic adhesive, a foam adhesive, an epoxy adhesive, epoxy resins, or polyurethane masses;
- wood-base materials mean also: MDF boards, HDF boards, chipboards, hardboard, fibreboards, or OSB boards;
- a grip handle means also: a single simple fixed handgrip made of metal and plastic, a single simple foldable handle, a simple flush-fitting handle or a handgrip with a jointing piece;
- a hard material for bottom, lid, and box means: a wood, a metal, a plastic, a sintered quartzite, a sintered quartz, or a glass;
- hard material for slat rectangular frames means: wood, a plastic, or a metal.

BRIEF SUMMARY OF THE INVENTION

The objective of the present invention is to provide a design of environment-friendly coffin eliminating the above-mentioned inconveniences of coffins known to date by means of constructing it out of intentionally selected materials in well-though-out combinations, including materials entirely resistant to drying out, decaying, swelling, and rotting, as well as materials ensuring complete tightness of the coffin for a long period of time. A further objective of the present invention is to facilitate the operation of lifting the coffin lid, especially when it is made of hard and heavy material, and stabilising it in the open position.

According to the invention, the point of the environment-friendly coffin consists in that its box assembly comprises: a casing made of natural stone plates, plate-shaped flats provided with a tapped mounting bore fixed and to inner or outer surfaces of plate side walls of said casing, plate-shaped metal washers with tapped mounting bores and fixed to these inner side walls, and a tubular element made of glass fibre mat or a metal mounted inside said casing and fixed to inner surfaces of plate side walls and to bottom of said box, made of natural stone slab or made of natural stone slab and a board made of wood-base material glued to said bottom by means of a glue-based sealing mass. In turn, the profiled lid assembly of said coffin has an external casing made of natural stone in the form of a solid with a bottom cascade-shaped cavity or a trough-shaped cavity having a profile of the truncated pyramid, with a lower side offset in the form of a slab frame, whereas in the inner profiled surface of said casing there is an insert made of wood-base material with the same profile and fixed by means of a glue to which a glass fibre mat is glued. It is favourable when inside the box assembly there are flat-bar U-shaped stirrups made of glass fibre, situated opposite the grip handles, and vertical elements of these stirrups fit tight to inner flats and to metal washers, with a tubular element located in such stirrups. Moreover, there are angle-shaped feet made of natural stone situated in corners of said box assembly and fixed to the box assembly's bottom made of natural stone as well as tee-shaped feet made of natural stone situated opposite each other at half of its length. It is also favourable when inner surface of the cuboidal element located inside the box is provided with two horizontally positioned slat rectangular frames fastened to said surface, of which one frame is situated on perimeter of the upper end of said element so that its upper face is flushed with upper face of said element and with upper face of the box, and the second slat rectangular frame is situated on perimeter of the lower end of the cuboidal element so that its lower face is flushed with lower face of said element, which together fit tight to the plate bottom of the box, where both of the two slat rectangular frames are topped together in their corners by means of vertically oriented slat angle-section shaped elements also fitting tight to walls of the cuboidal element, whereas each of both opposite longer lower slat of the slat frame is provided with three angle-section shaped elements evenly distributed along their lengths and situated opposite each other, fastened to said plate bottom and to said slats, whereas to the upper face of one of the longer slat of the slat rectangular frame attached are horizontal members of angle hinges upper revolving members of which are fastened to inner side surface of the box's lid via plate-shaped rectangular elements fastened to said lid, and moreover to the side surface of said longer slats and to these rectangular elements attached are three sets of gas springs, while ends of piston rods of these gas springs are fastened to the side surface of said longer slat, and ends of cylinders of said gas springs are attached to plate-shaped rectangular elements. It is also favourable when the angle hinge comprises a rectangular lower horizontal element ended with a sleeve element with a pin mounted in it and an angle upper element ended at the bottom also with a sleeve element which is planted rotationally on said pin, and moreover also when both the box and its bottom and the lid, as well as both slat rectangular frames are topped together by means of angle-section shaped elements of the cuboidal element are made of hard material.

The coffin made of natural stone and sealing materials according to the invention ensures certainty that it will maintain its external appearance and meet requirements concerning its basic function and purpose for a long period of time counted in decades and even in centuries. Moreover, equipping the coffin's tubular rectangular element made of glass fibre mat with slat rectangular frames situated on both opposite ends flushed with their faces and topped together in corners of said tubular element by means of angle-section shaped elements allowed to make said tubular element much more rigid and connect it directly with the plate bottom of the coffin box. Further, one of the longer slats of the upper rectangular slat frame allowed to connect the box with the coffin's lid by means of hinges. Moreover, equipping the coffin with three sets of gas springs connecting the box and the lid allowed to lift the heavy lid, especially when made of a made of natural stone in the large sense, to its upper position easily and without effort.

BRIEF DESCRIPTION OF THE SEVERAL VIEWS OF THE DRAWINGS

The subject of the invention is illustrated by means of example embodiments shown in the drawings of which FIGS. 1-5 present the first version of embodiment of the environment-friendly coffin with a flat lid, whereas FIG. 1 shows the coffin in a perspective view, FIG. 2—the same coffin in the top view, FIG. 3—the same coffin in the longitudinal cross-section along line A-A, FIG. 4—the same coffin in vertical cross-section along line B-B, and FIG. 5—the same coffin with its component elements disassembled in a perspective view;

FIGS. 6-10 present the second version of embodiment of the environment-friendly coffin also with a flat lid, whereas FIG. 6 shows the coffin in the perspective view, FIG. 7—the same coffin in the top view, FIG. 8—the same coffin in the longitudinal cross-section along line C-C, FIG. 9—the same coffin in the vertical cross-section along line D-D, FIG. 10—the same coffin with its component elements disassembled in a perspective view;

FIGS. 11-15 present the third version of embodiment of the environment-friendly coffin with a lid in the form of a truncated pyramid, whereas FIG. 11 shows the coffin in the perspective view, FIG. 12—the same coffin in the top view, FIG. 13—the same coffin in the vertical longitudinal cross section along line E-E.

FIG. 14—the same coffin in the vertical transverse cross-section along line F-F, FIG. 15—the same coffin with its component elements disassembled in a perspective view; further, FIGS. 16-20 present the fourth version of embodiment of the environment-friendly coffin with a lid also in the form of a pyramid, whereas FIG. 16 presents the coffin with component elements of its box and lid disassembled in a perspective view, FIG. 17—the same coffin in the top view, FIG. 18—the same coffin in the vertical longitudinal cross-section along line G-G.

FIG. 19—the same coffin in the vertical transversal cross-section along line H-H, FIG. 20—the same coffin with all its component elements disassembled in a perspective view;

DETAILED DESCRIPTION OF THE INVENTION

Figure 1:
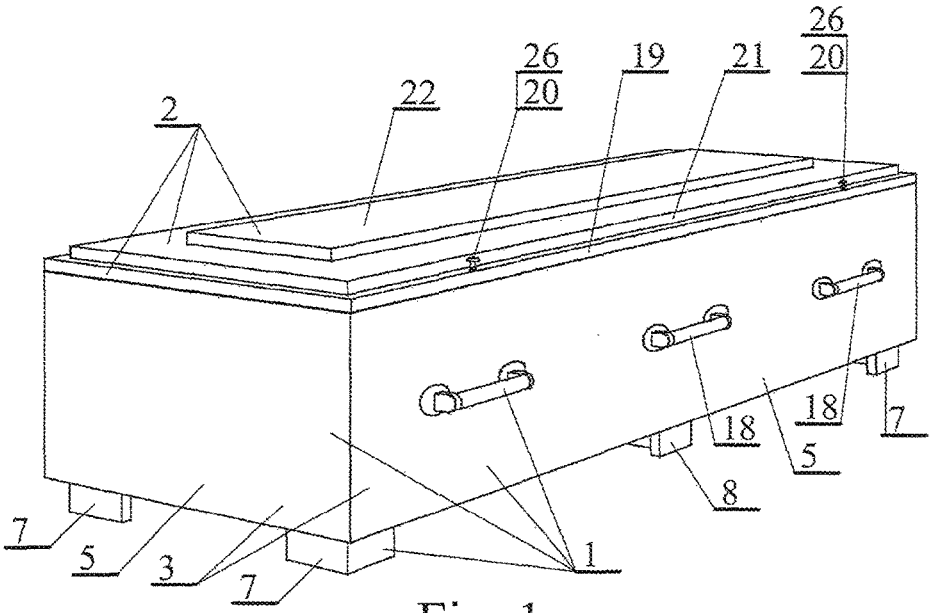
Figure 2:
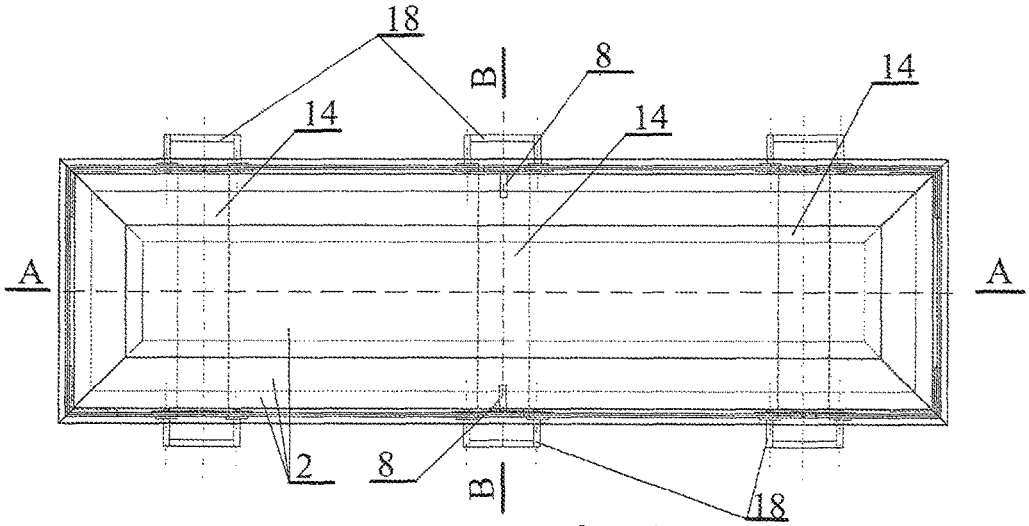
Figures 3, 4:
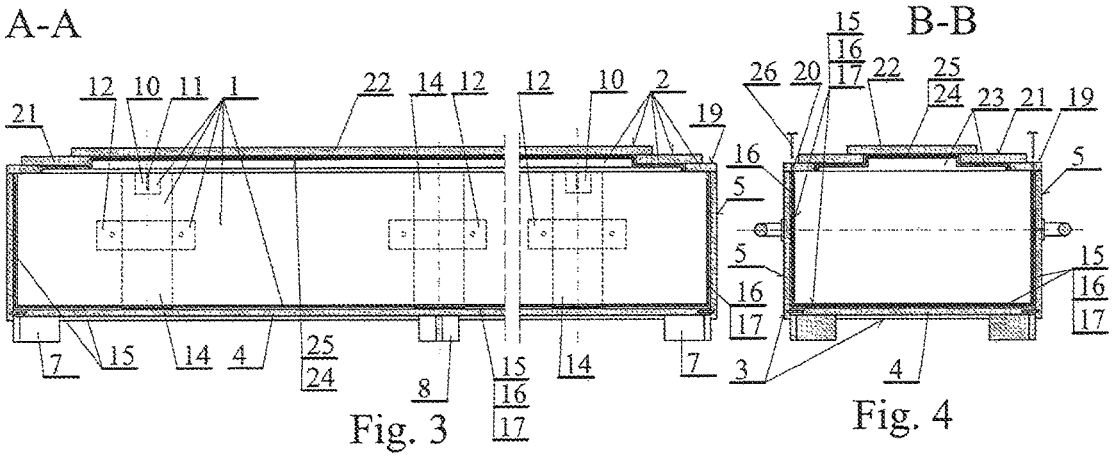
Figure 5:
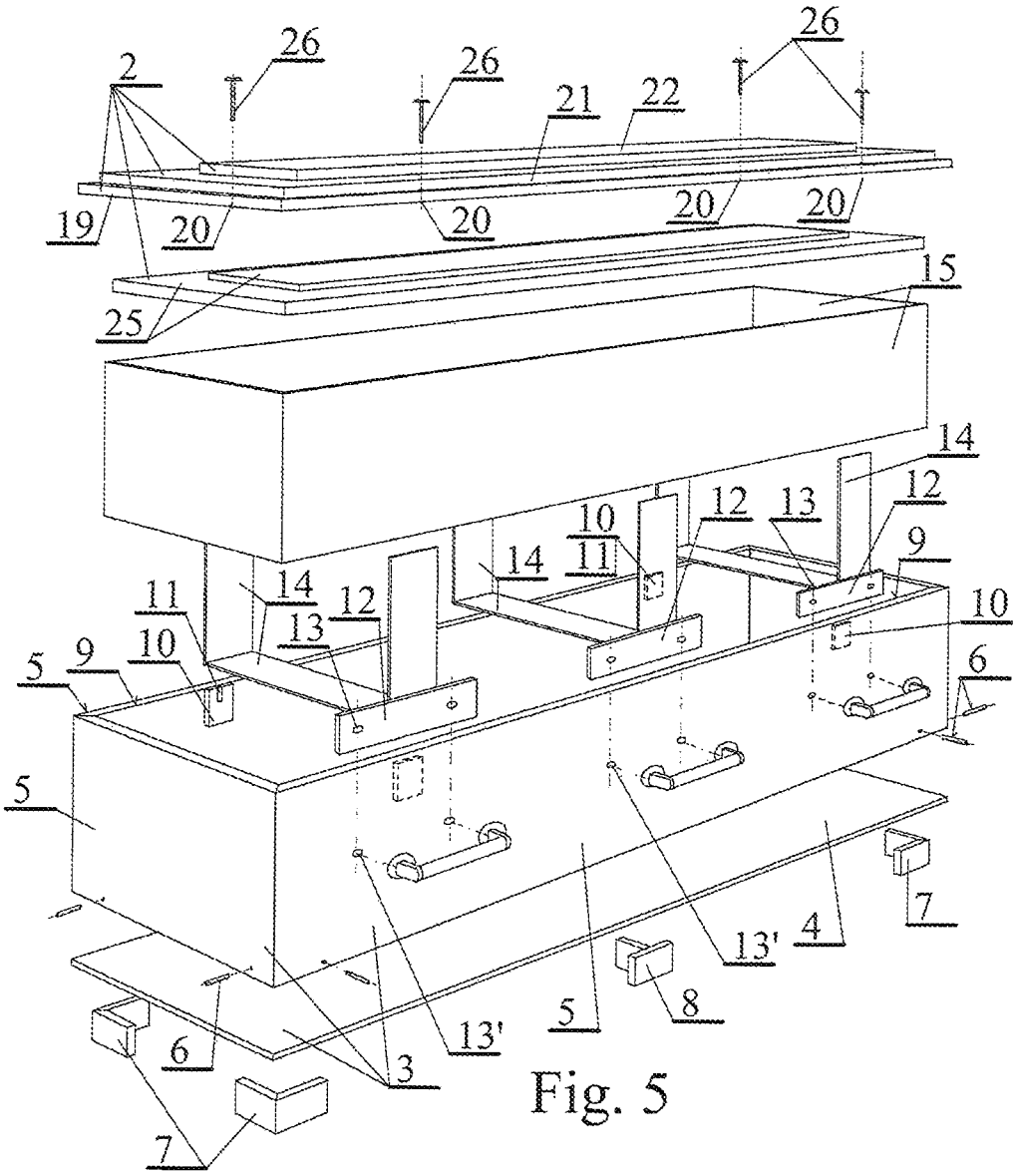

The environment-friendly coffin according to the first version of its embodiment shown in FIGS. 1-5 comprises the box assembly 1 and the flat lit assembly 2 covering it, whereas the box assembly 1 is a cuboidal casing 3 made of natural stone plates the bottom 4 of which, made also of a natural stone plate, is connected with plate side walls 5 of said casing by means of metal fixing pins 6 planted tightly in bores made in, said walls, and said box assembly rests on four angle-section shaped feet 7 made of natural stone, connected permanently to and situated in corners of said bottom, and on two Tee-shaped feet 8 made of natural stone, situated opposite each other in the central portion of the plate bottom 4. Further, to each of the two inner surfaces 9 of longer side walls 5 of the casing 3 in upper portions of said walls there are two plate-shaped flats 10 fastened opposite each other, with tapped bores 11 made in them, and below said flats, in central portion of each of said side walls, there are three plate-shaped metal washers 12 fastened opposite each other with tapped bores 13 made in them and situated opposite mounting, bores 13' made in both plate side walls 5 of casing 3. Moreover, each of said washers is pressed by means of a U-shaped flat bar reinforcing stirrups 14 made of glass fibre mat resting also on the plate bottom 4, whereas said stirrups hold a cuboidal element 15 having a rectangular cross-section, made of glass fibre mat and connected with said washers and flats by means of resins and glues, and the circumferential slit 16 formed between them is filled with glue-based sealing mass 17, including also the plate bottom 4. Further, to each of the two longer plate side walls 5 of casing 3, through bores 14 in said walls and tapped bores 13 in plate-shaped washers 12, three grip handles 18 are attached by means of bolts.

Further, the flat lid assembly comprises an outer casing made of natural stone, formed by a lower rectangular plate frame 19 with external dimensions analogous to those of the box assembly 1, provided on both of its longer sides with mounting holes 20 situated opposite tapped bores 11 in flats 10 of said box and further comprises a second rectangular plate frame 21 fixed to upper surface of frame 19 but having smaller external dimensions, and inner rectangular openings of both frames are covered from the above with a rectangular plate-shaped element 22 with external dimensions smaller than those of the plate frame 21 to the upper surface of which it is secured. Moreover, to lower surface of the cascade-shaped cavity 23 constructed from the above-described elements attached is, by means of the resin-glue mass 24, glass fibre mat 25 with profile identical to this of the cavity. The box assembly 1 of the coffin is connected with the flat lid assembly 2 by means of metal bolts 26, into which, through mounting holes 20 in plate frame 19 of the lid assembly are screwed into tapped bores 11 in flats 10 of the box assembly 1.

An improved version of the coffin is provided additionally with two vertically oriented slat rectangular frames 33 and 34 fastened to it, of which one is situated on perimeter of the upper end of said element so that its upper face 35 is flushed with its upper face 36 and lower face 37 of box 1, and the second slat rectangular frame 34 is situated on perimeter of the lower end of the tubular rectangular element 15 made of glass fibre mat so that its lower face 38 is flushed with lower face 39 of said element which together fit tight to the plate bottom 4 of the box, where both of the two slat rectangular frames 33 and 34 are topped together in their corners by means of vertically oriented slat angle-section shaped elements 40 fitting tight also to walls of the tubular rectangular element 15, and moreover each of lower longer opposite slats 41 and 42 of slat frame 34 is provided with three angle-section shaped elements 43, evenly distributed along their lengths and situated opposite each other, fastened to the plate bottom 4 and to said slats, whereas to the upper face 35 of one longer slat 44 of the slat rectangular frame 33 fastened are horizontal members 45 of angle hinges 46 evenly distributed along its length, and upper revolving members 47 of said hinges are fastened to inner side surface of lid 2 of the box 1 via plate-shaped rectangular elements 48. Further, three sets of gas springs 49 are fastened to side surface of the longer slat 44 and to said rectangular elements next to angle hinges 46 so that ends 50 of piston rods 51 of said gas springs are fastened to side surface 52 of the longer slat 44, and ends 53 of cylinders 54 of these gas springs are attached to plate-shaped rectangular elements 48. The angle hinge 46 comprises a rectangular lower horizontal element 45 ended with sleeve element 55 with pin 56 mounted in it and an angle upper element 47 ended at its bottom also with a sleeve element 57 which is mounted rotationally on pin 56 of lower member 45.

Figure 6:
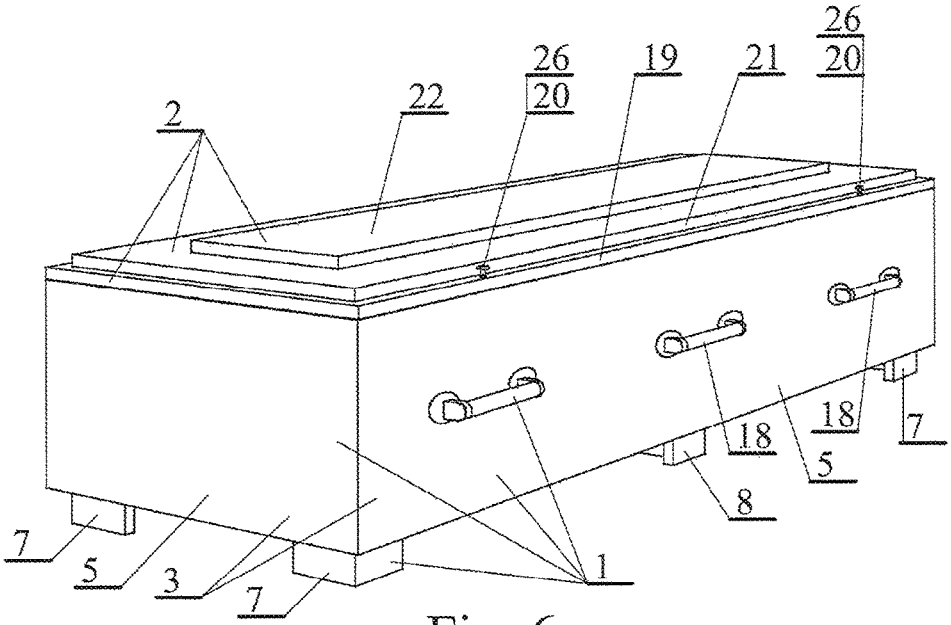
Figure 7:
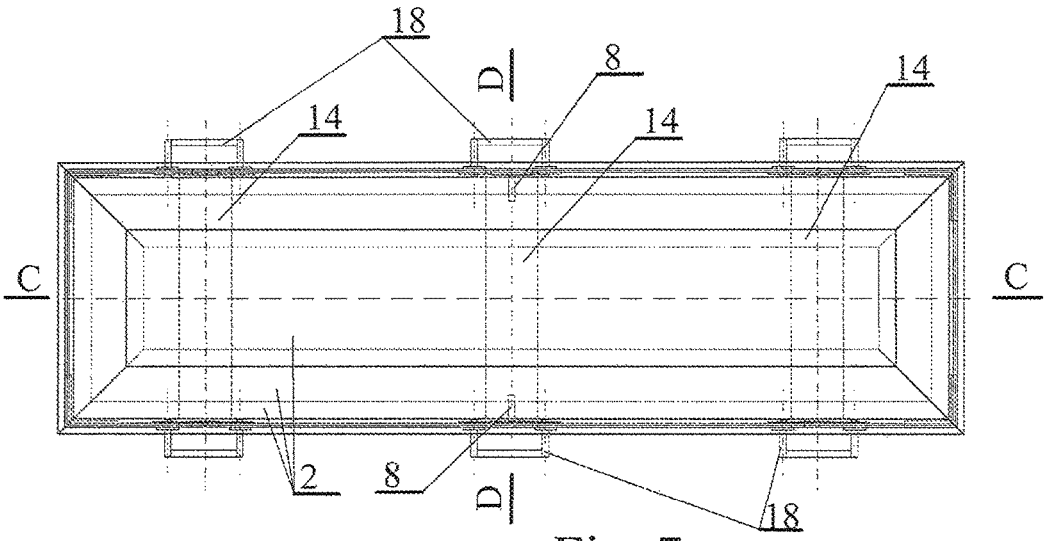
Figures 8, 9:
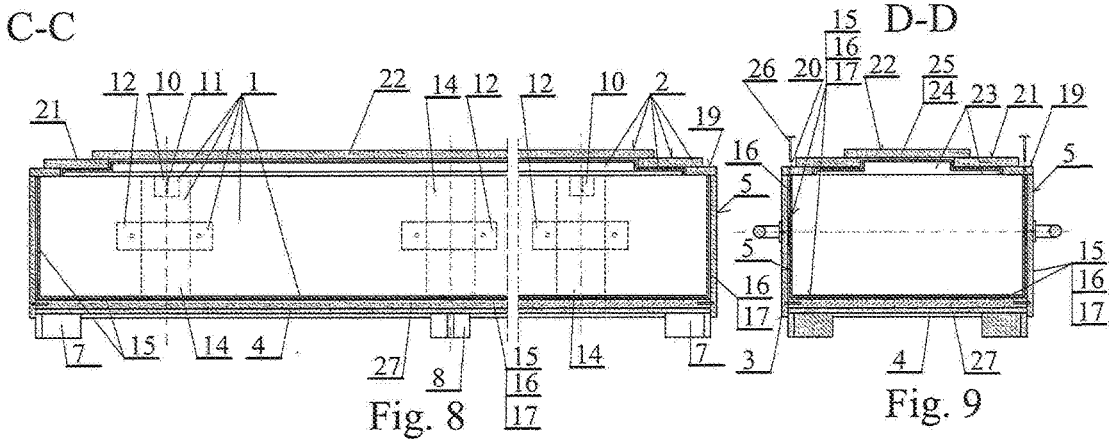
Figure 10:
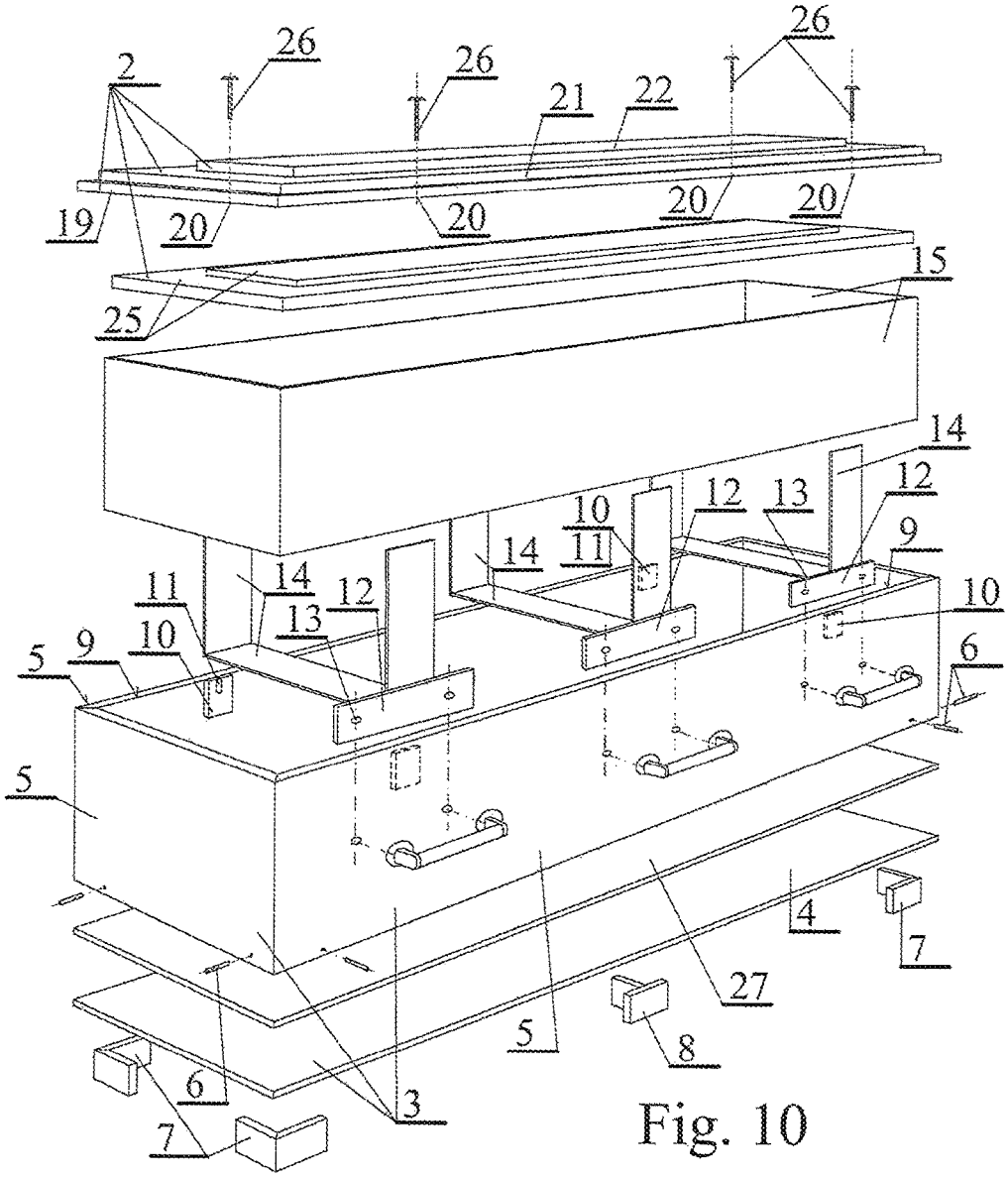

The environment-friendly coffin according to the second version of its embodiment shown in FIGS. 6-10 comprises also the box assembly 1 and the flat lid assembly 2 covering it, whereas the box assembly 1 represents a cuboidal casing 3 made of natural stone plates, to the plate bottom 4 of which, made also of natural stone, glued is board 7 made of wood-base material and connected with plate side walls 5 of said casing by means of metal fixing pins 6 mounted tightly in bores made in said walls; said box assembly rests on four angle-section shaped feet 7 made of natural stone, situated in corners of said bottom, and on two Tee-shaped feet 8 made of natural stone situated opposite each other in the central portion of the plate bottom 4, where all the feet are permanently connected to said bottom. Further, to each of the two inner surfaces 9 of longer side walls 5 of the casing 3 in upper portions of said walls there are two plate-shaped flats 10 fastened opposite each other, with tapped bores 11 made in them, and below said flats, in central portion of each of said side walls, there are three plate-shaped metal washers 12 fastened opposite each other with tapped bores 13 made in them and situated opposite mounting bores 14 made in both plate side walls 5 of casing 3. Moreover, each of said washers is pressed by means of a U-shaped flat bar reinforcing stirrup 14 made of glass fibre mat resting also on the plate bottom 4, whereas the stirrups hold a cuboidal element 15 having a rectangular cross-section, made of glass fibre mat connected with these washers and flats by means of resins and glues, and circumferential slit 16 formed between them is filled with glue-based sealing mass 17, including also the plate bottom 4. Further, to each of the two longer plate side walls 5 of casing 3, through bores 14 in said walls and tapped bores 13 in plate-shaped washers 12, three grip handles 18 are attached by means of bolts.

Further, the flat lid assembly 2 in this version of the coffin, shown in FIGS. 6-10, has a structure identical to this described above for the flat lid employed in the first version of the environment-friendly coffin shown in FIGS. 1-5.

Figure 11:
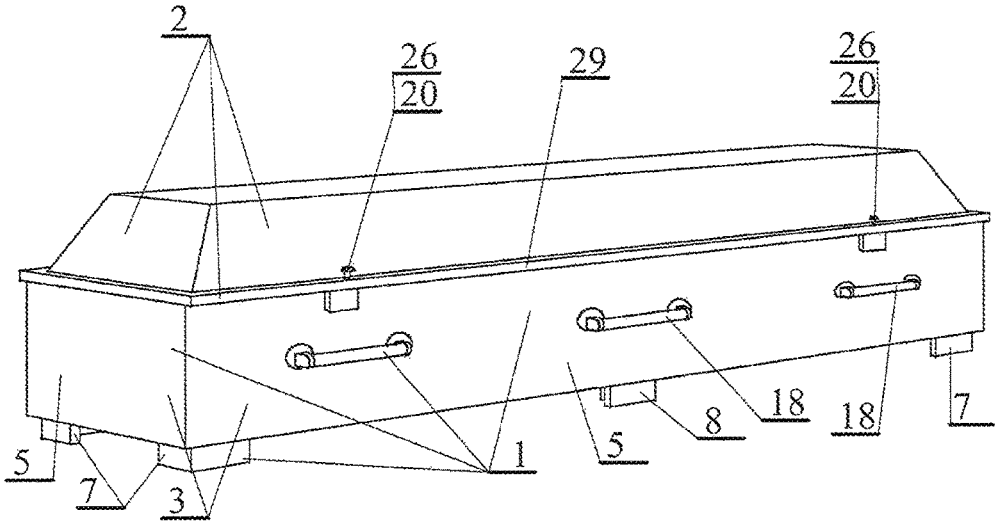
Figure 12:
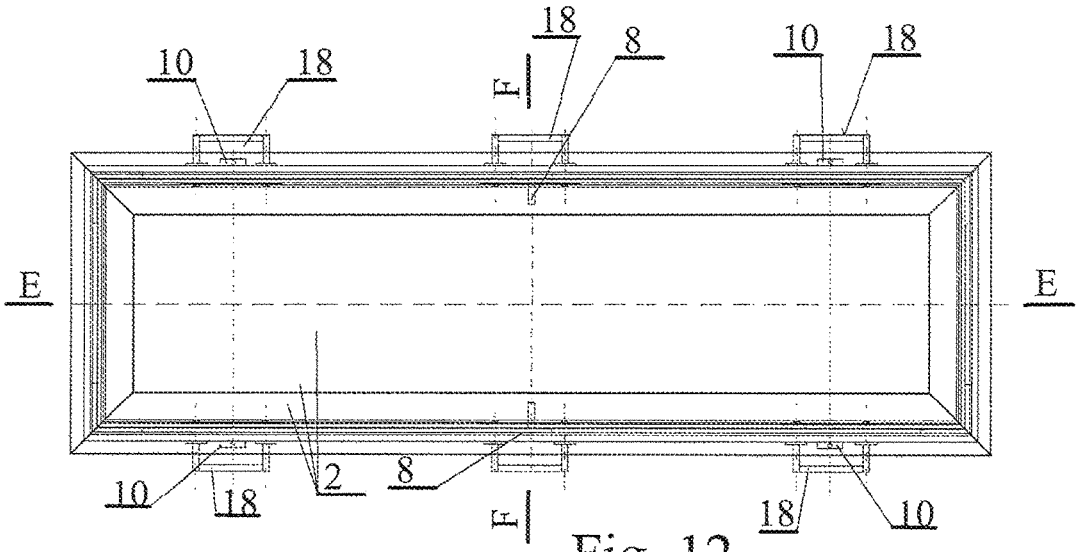
Figures 13, 14:
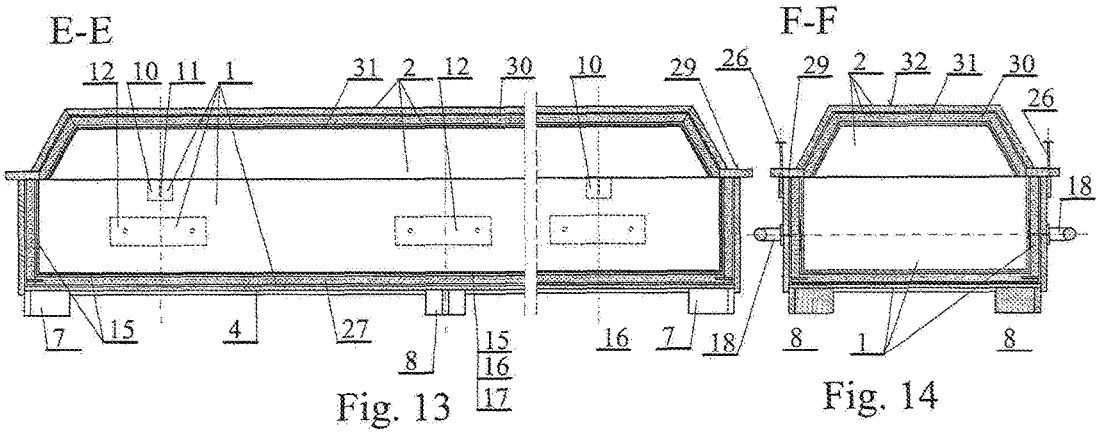
Figure 15:
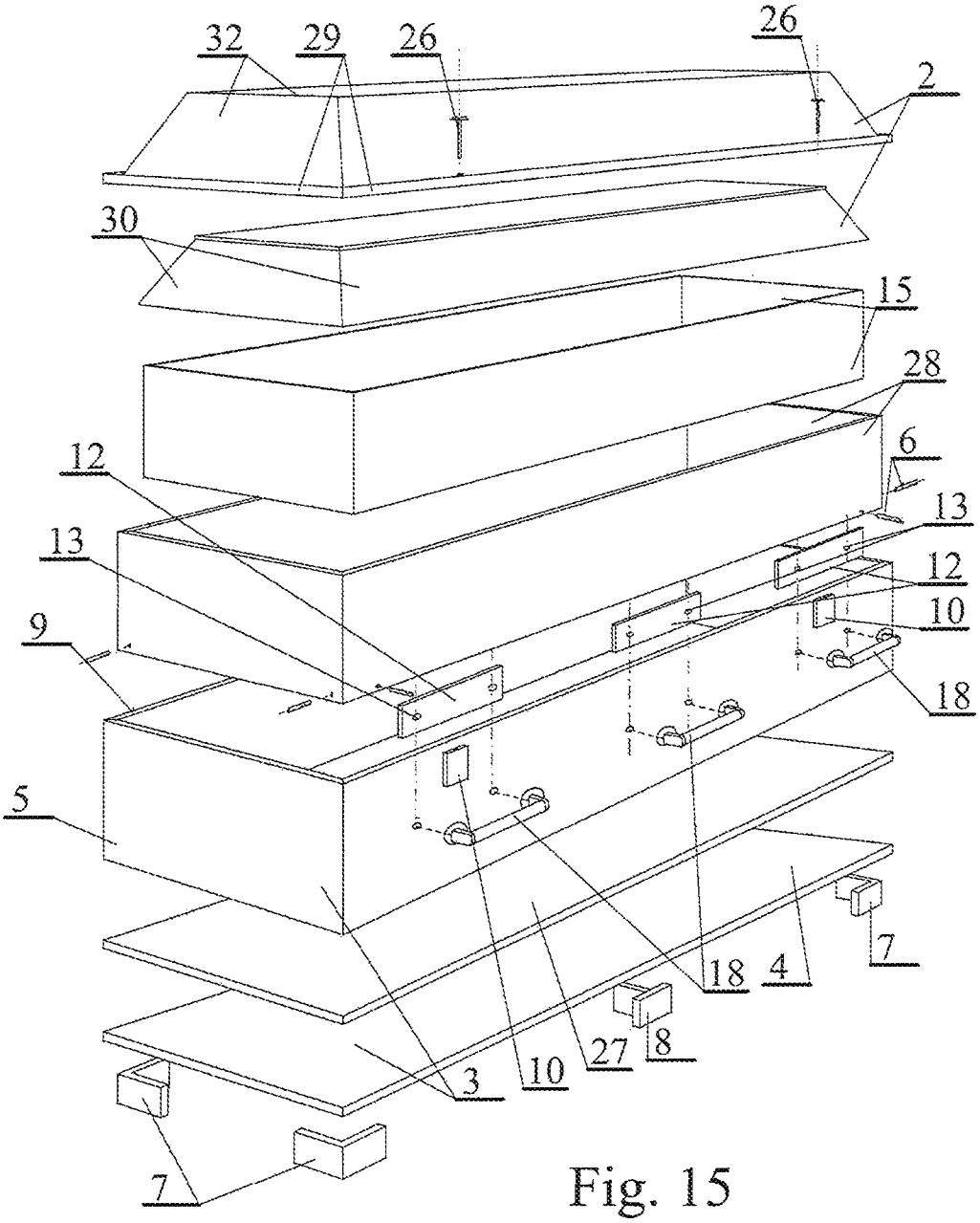

The environment-friendly coffin according to the second version of its embodiment shown in FIGS. 11-15 comprises the cuboidal box assembly 1 and the pyramidal lid assembly 2 covering it made in the form of a hollow truncated rectangular pyramid, where the box assembly 1 includes a cuboidal casing 3 made of natural stone plates, to the plate bottom 4 made also of natural stone glued is board 27 made of wood-base material, such board being connected with plate side walls 5 of said casing by means of fixing pins 6 planted tightly in bores made in such walls and rests on angle-section shaped feet 7 made of natural stone, connected permanently to and situated in corners of said bottom, and on two Tee-shaped feet 8 made of natural stone, situated opposite each other in the central portion of the plate bottom 4. Further, to each of the two inner surfaces 9 of longer side walls 5 of the stone casing 3 in upper portions of said walls there are two plate-shaped flats 10 fastened opposite each other, with tapped bores 11 made in them, while to each of inner surfaces of said two side walls, in central portions thereof, fastened are three plate-shaped metal washers 12 situated opposite each other with tapped mounting bores 13, situated opposite mounting bores 14, made in both plate side walls 5 of casing 3, inside which a cuboidal element 28 is located having a rectangular cross-section, made of wood-base material, longer walls of which fit tight to surfaces of flats 10 and washers 12, and within said cuboidal element there is an analogous cuboidal element 15 having a rectangular cross-section, but made of glass fibre mat, assembled with the use of resins and glues, whereas circumferential slit 16 formed between them is filled with glue-based sealing mass 17, including also a double plate bottom 4 and 27. Moreover, to each of the both longer plate side walls 5 of the casing 3, three grip handles 18 each are attached by means of bolts through bores 14 made in said walls and threaded bores 13 in plate-shaped washers 12

Further, the pyramidal lid assembly 2 comprises an outer casing made of natural stone composed of rectangular plate frame 29 made also of natural stone, inner side walls of which are rigidly connected with trough-shaped element 30 with a profile of the truncated pyramid with a rectangular frame-shaped base, made of a wood-base material, to inner walls of which glued is glass fibre mat 31 by means of resins, whereas to the outer surface of the trough-shaped element 30 and to rectangular frame 29 of the assembly, glued is an analogous trough-shaped element 32 with a profile of the truncated pyramid but made of natural stone, where on the upper surface of rectangular frame 29 through mounting holes 20 are made situated opposite the tapped bores 11 made in outer flats 10. The box assembly 1 of the coffin is connected with the pyramidal lid assembly 2 by means of metal bolts 26, which, through holes 20 in rectangular plate frame 29 of said lid, are screwed into tapped bores 11 in outer fiats 10 of the box assembly 1.

Figure 16:
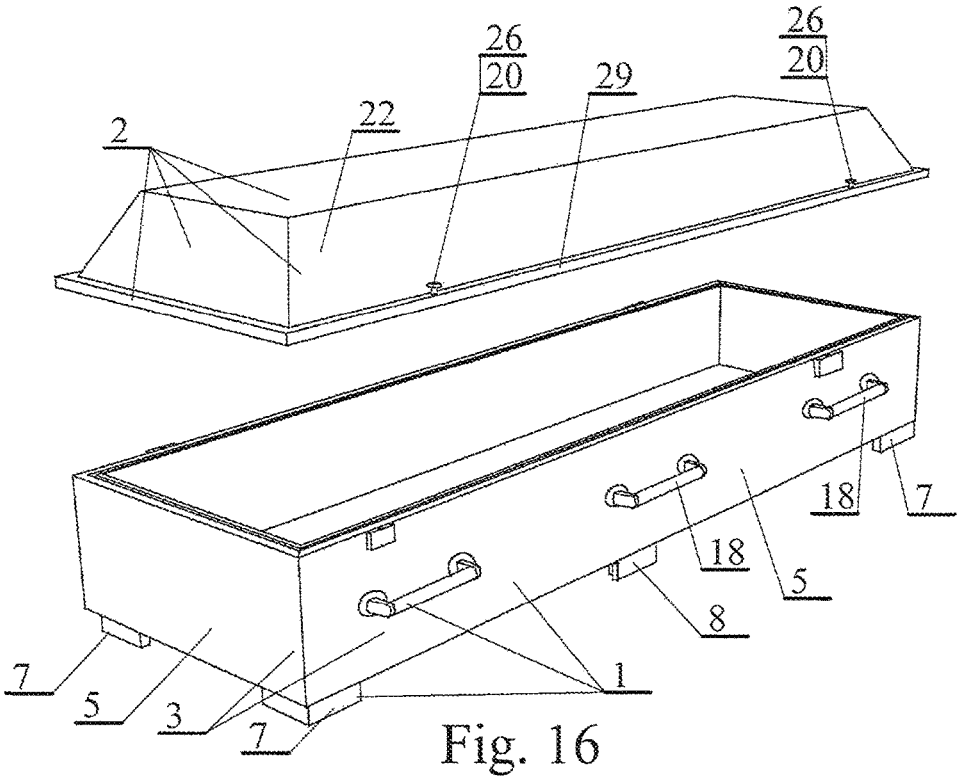
Figure 17:
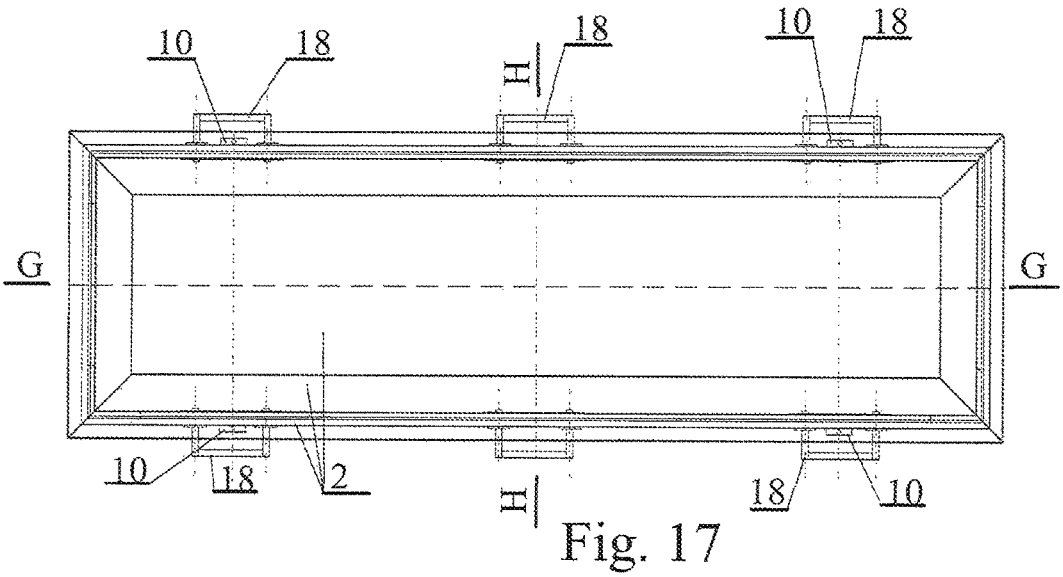
Figure 18:
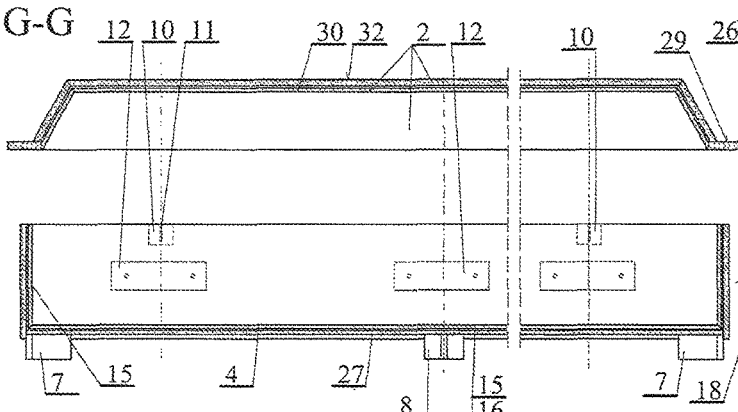
Figure 19:
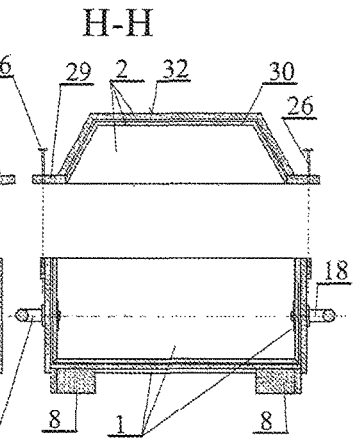
Figure 20:
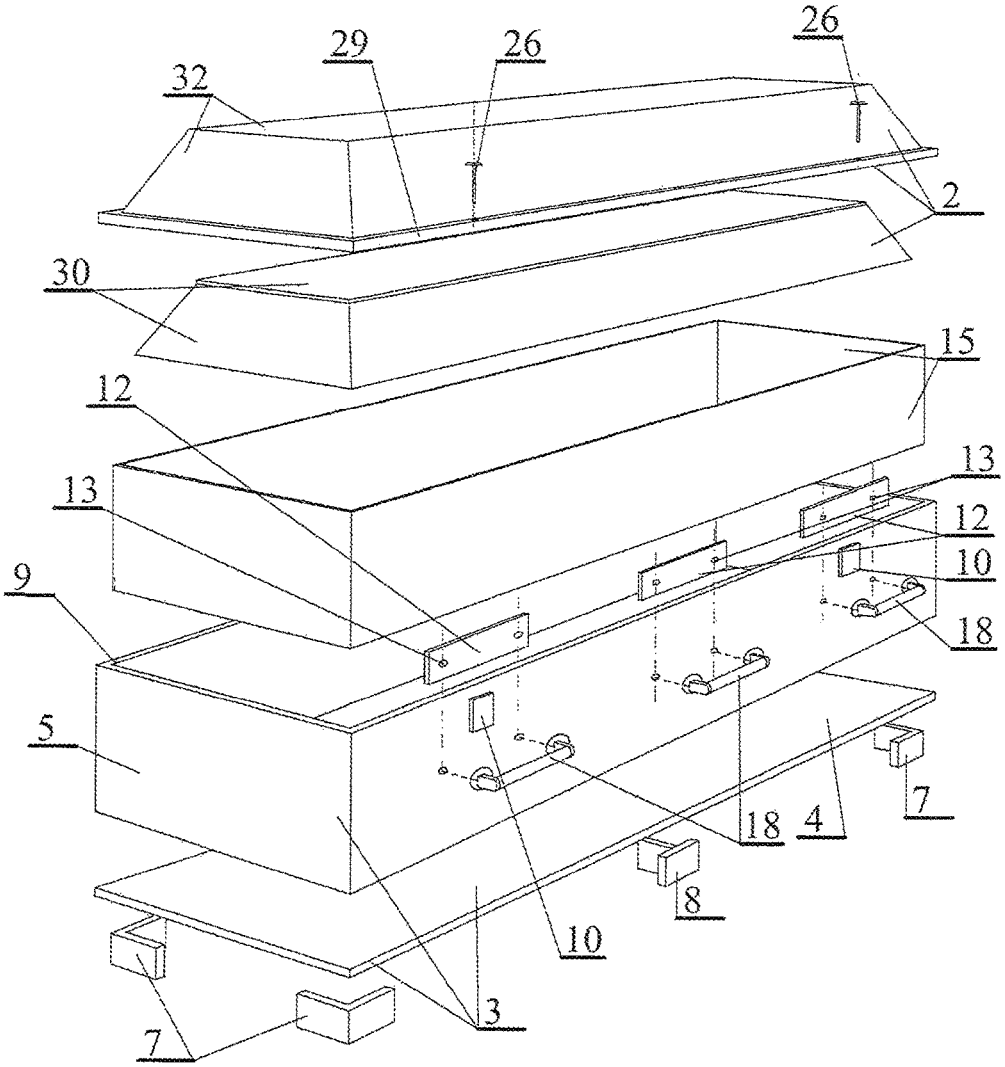
Figure 21:
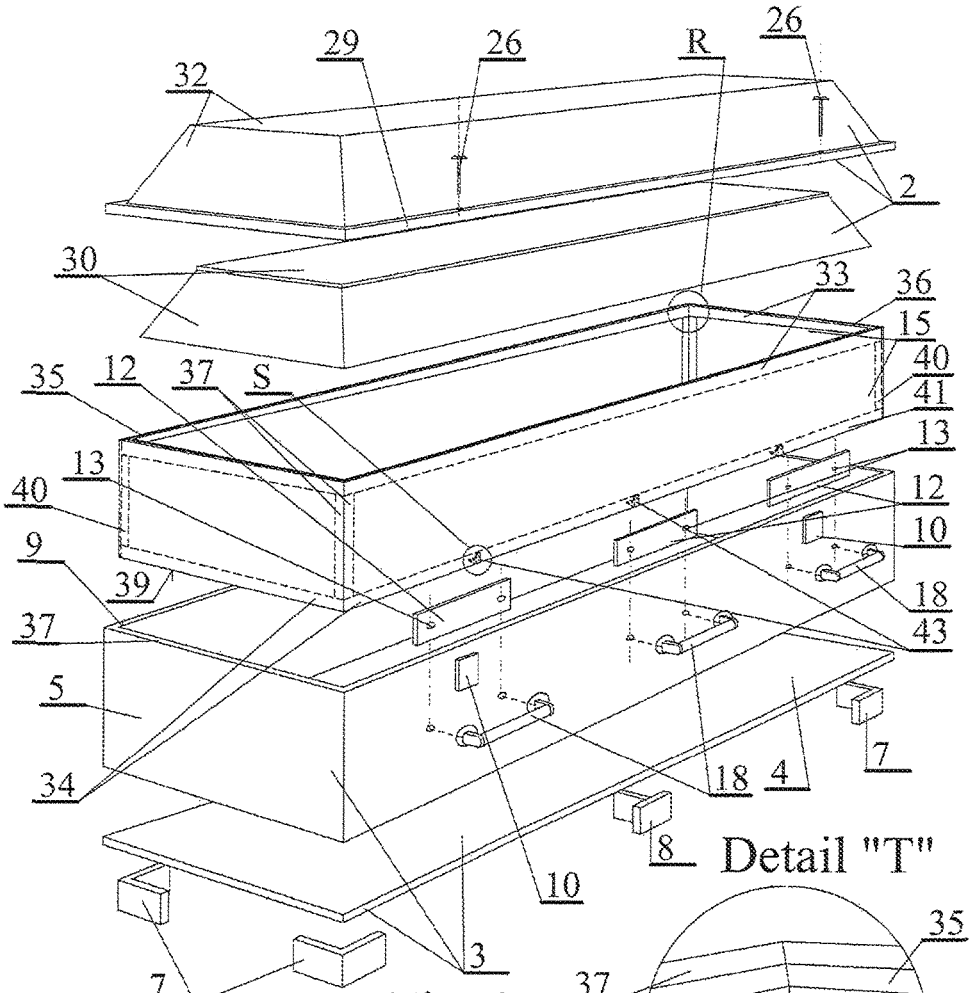
FIG. 21 presents the fifth version of embodiment of the environment-friendly coffin with the inner cuboidal element made of glass fibre mat and localised in the coffin's box casing by means of slat rectangular frames with all its basic elements disassembled in a perspective view, FIG. 22—detail "R" of the corner formed by the element made of glass fibre mat and slat elements in a view toward the inner corner, FIG. 23—detail "S" of the connection of a angle-section shaped element with the box bottom and with longer lower slats of the lower rectangular frame attached to the inner cuboidal element made of glass fibre mat, FIG. 24 the same connection in the vertical cross-section along line K-K.
Figure 22:
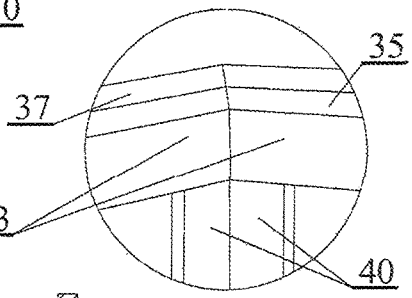
Figure 23:
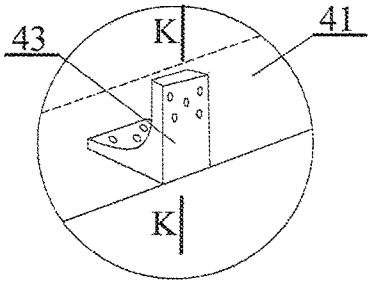
Figure 24:
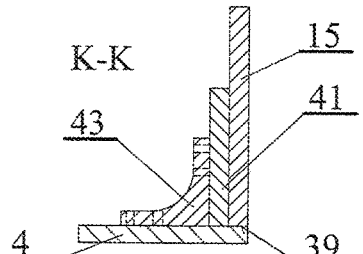
Figure 25:
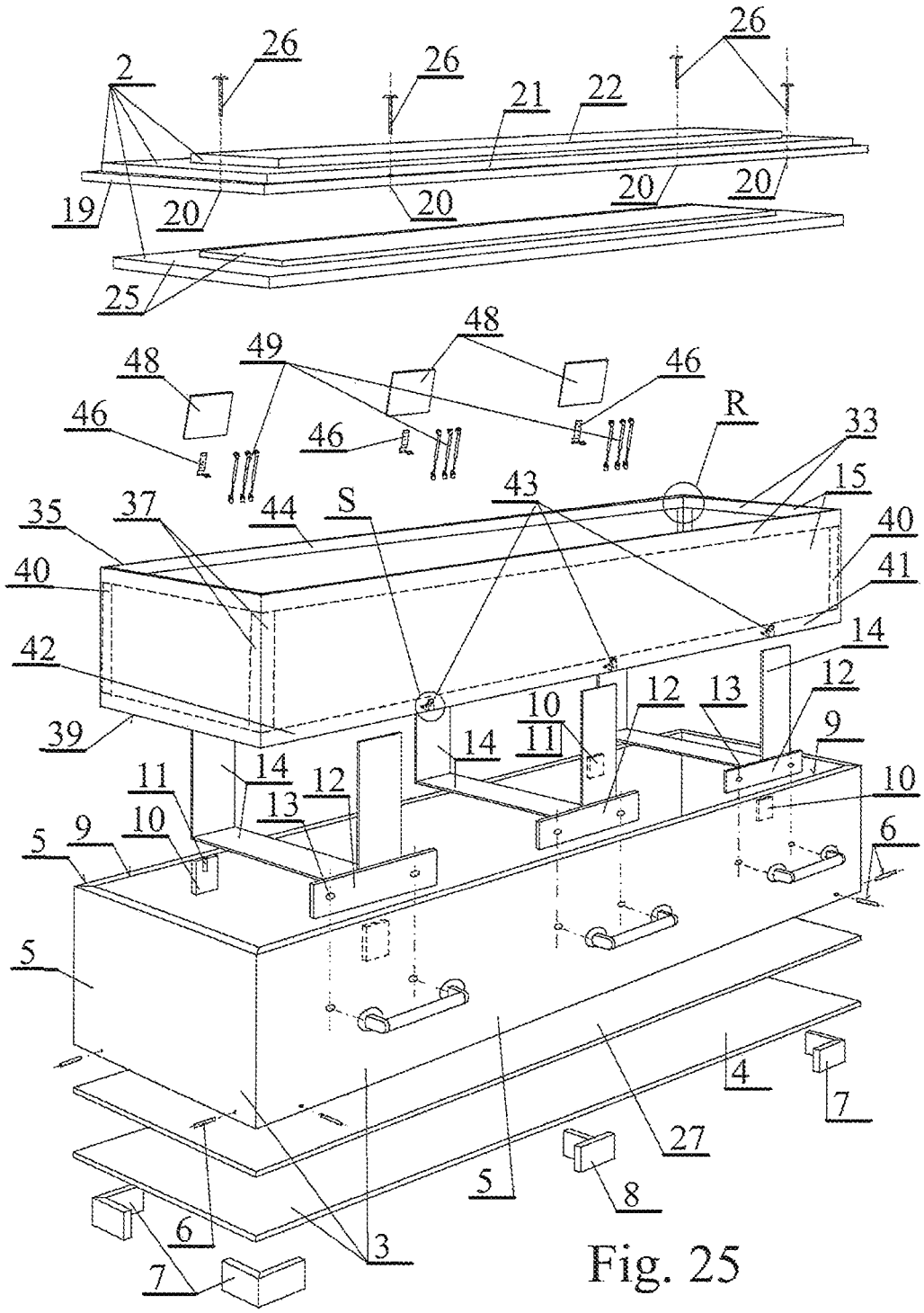
FIG. 25—a variant of the coffin shown in FIGS. 1-5 with its lid in open position and hinges and gas spring sets connecting the box and the lid in a perspective view.
Figure 26:
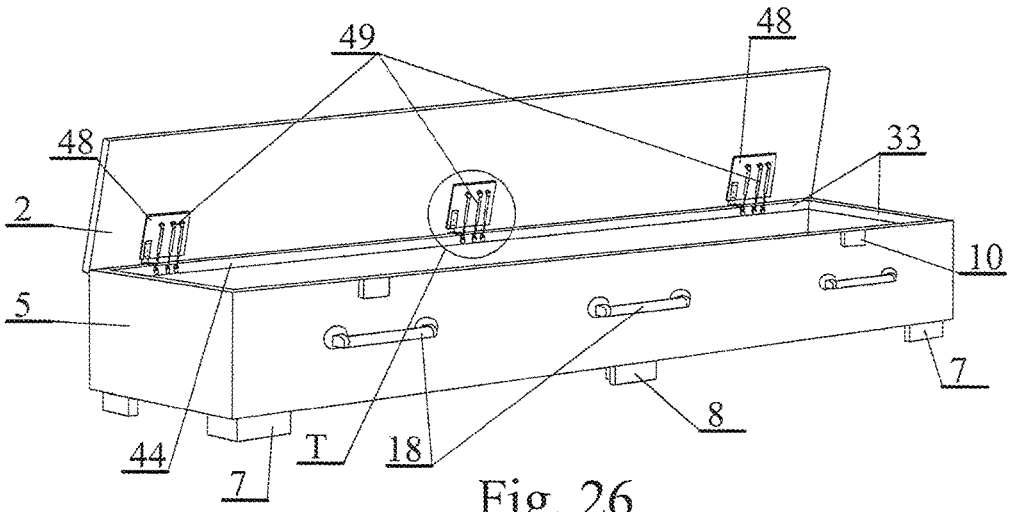
FIG. 26—detail "T" showing an enlarged view of one of these hinge sets and gas springs sets connecting lid and coffin box elements.
Figure 27:
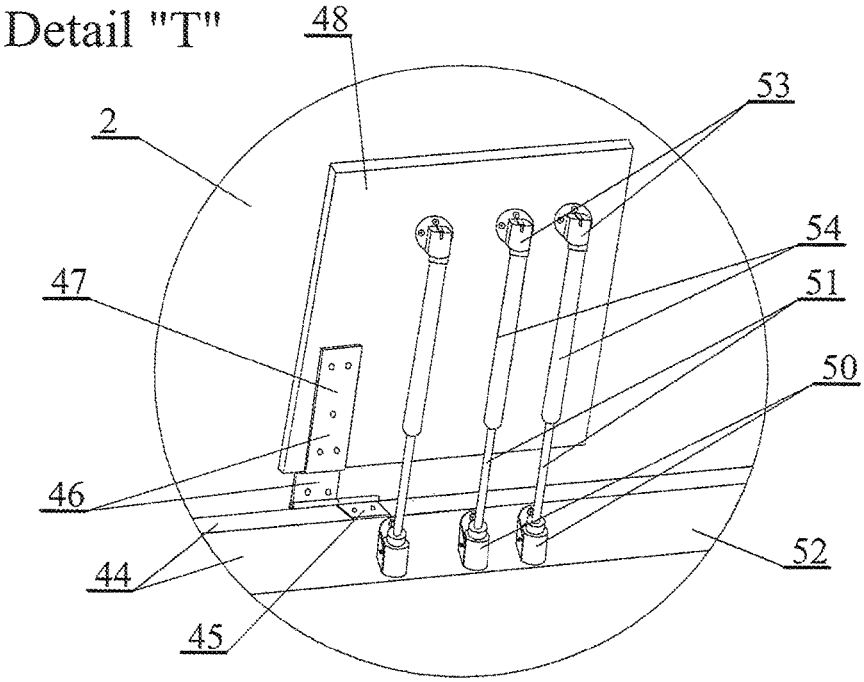
FIG. 27—an angle hinge connecting the box of the coffin with its lid in a perspective view.
Figure 28:
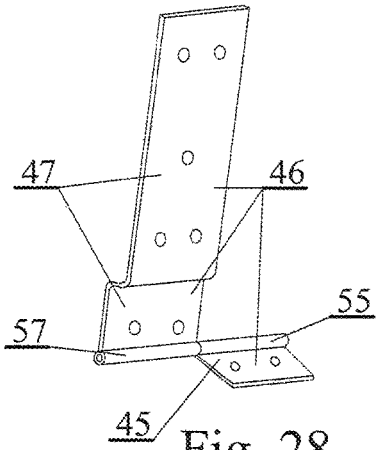
FIG. 28—upper element of the hinge in the front view.
Figure 29:
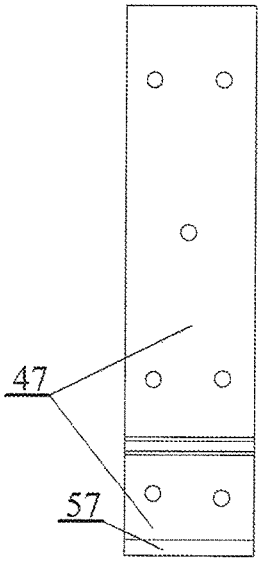
FIG. 29—the same element of the hinge in the side view.
Figure 30:
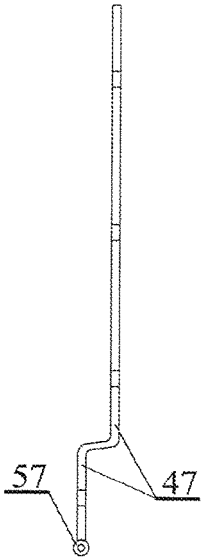
FIG. 30—lower element of the angle hinge in the front view.
Figure 31:
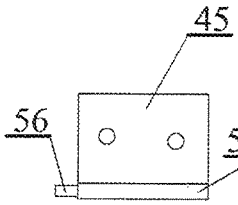
FIG. 31—the same lower element of the hinge in the side view.
Figure 32:
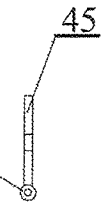
FIG. 32 presents a through-shaped element with a profile of the truncated pyramid.

Further, the environment-friendly coffin according to the second version of its embodiment shown in FIGS. 16-20 comprises a cuboidal box 1 and a lid 2, also pyramidal in this versions, made in the form of a hollow truncated rectangular pyramid, where the box for this version of the environment-friendly coffin has a structure similar to this of boxes of the first and the third version of the environment-friendly coffin shown in FIGS. 1-5 and FIGS. 11-15. The difference between these coffins consists only in that in the fourth version of embodiment of the environment-friendly coffin, plate-shaped flats 10 of the box assembly 1 with tapped bores 11 made in them are fastened to outer surfaces of both longer side walls 5 of the casing 3 made of natural stone, and its cuboidal element 15 having a rectangular cross-section fixed to inner surface of said stone casing is made of metal, in view of which this version of embodiment lacks the cuboidal element (insert) 28 made of a wood-base material, whereas the pyramidal lid assembly 2 has construction identical to this of the pyramidal lid assembly 2 according to the third version of embodiment of the coffin, and the difference between them consists only in that its trough-shaped element 30 with a profile of the truncated pyramid is made of sheet metal. An improved version of the coffin, apart from applying in its structure a trough-shaped element 32 of lid 2 and side walls 5 of casing 3 and bottom 4 of the box assembly 1 made of a hard material, its inner surface having the form of the tubular rectangular element 15 made of glass fibre mat is additionally equipped with horizontally oriented slat rectangular frames 33 and 34 fastened to it, of which one is situated on perimeter of the upper element so that its upper face 35 is flushed with upper face 36 of cuboidal element and upper face 37 of box 1, and the second angle-section slat rectangular frame 34 is situated on perimeter of the lower end of said tubular rectangular element 15 so that its lower face 38 is flushed with the lower face 39 of said element which together fit tight to plate bottom 4 of box 1, whereas both of said slat rectangular frames 33 and 34 are topped together in their corners by means of vertically oriented slat angle-section shaped elements 40 fitting tight also to walls of the tubular rectangular element 15, and each of the two longer lower opposite slats 41 and 42 of the slat frame 34 is equipped with three angle-section shaped elements 43 evenly distributed along their lengths, attached to the plate bottom 4 and to said slats, as shown in FIGS. 21-24.

The environment-friendly coffin in its improved according to the second version of its embodiment shown in FIGS. 21-24 comprises a cuboidal box 1 and a pyramidal lid 2 covering it made in the form of a hollow truncated rectangular pyramid, where the box for this version of the environment-friendly coffin has a structure similar to this of the box in the first and the third version of embodiment of the coffin shown in FIGS. 1-5 and FIGS. 11-15, and moreover both the outer trough-shaped element 32 of lid 2 as well as side walls 5 of casing 3 and the bottom 4 of the box assembly 1 are made of a hard material. The difference between these coffins consists in that in this version of embodiment of the environment-friendly coffin, the plate-shaped flats 10 of the box assembly 1 with tapped bores 11 made in said flats fastened to outer surfaces of both longer side walls 5 of casing 3 are also made of a hard material and therefore this version lacks the cuboidal element called the insert and made of a wood-base material, whereas the pyramidal lid assembly 2 has the structure identical to this of the pyramidal lid assembly 2 according to the third version of embodiment of the coffin, and the difference between them consists only in that its trough-shaped element 30 with a profile of the truncated pyramid is made of sheet metal.

LIST OF DESIGNATIONS USED IN FIGURES

1. box assembly
2. flat lid assembly
3. cuboidal casing, stone plate
4. casing bottom, stone plate
5. casing side walls, stone plate
6. metal locking blocks
7. angle-section shaped feet, stone
8. Tee-shaped feet, stone
9. inner surfaces of the casing's longer walls
10. flats
11. tapped bores in flats 12. plate-shaped plastic washers
13. mounting bores
14. reinforcing stirrups
15. tubular rectangular element made of glass fibre
16. circumferential slit
17. glue-based sealing mass
18. grip handles
19. plate rectangular stone frame
20. mounting bores
21. plate rectangular stone frame
22. rectangular plate element
23. cascade-shaped cavity
24. resin glue mass
25. glass fibre mat
26. metal bolts
27. board made of a wood-base material
28. cuboidal element
29. plate stone frame
30. trough-shaped element made of a wood-base material
31. glass fibre mat
32. stone trough-shaped element
33. upper slat rectangular frame,
34. lower slat rectangular frame,
35. upper face of the upper slat rectangular frame (33)
36. upper face of the cuboidal element (15)
37. upper face of box (1)
38. lower face of the lower slat rectangular frame
39. lower face of the cuboidal element (15)
40. slat angle-section elements in corners of frames (33 and 34)
41. longer slat of the lower frame (34)
42. longer slat of the lower frame (34)
43. three angle-section shaped elements
44. one longer slat of frame (33)
45. angle hinge horizontal elements
46. angle hinges
47. revolving angle-section shaped upper elements of angle hinges
48. plate-shaped rectangular elements attached to lid (2)
49. three sets of gas springs
50. lower ends of gas spring rod pistons
51. gas spring rod pistons
52. side surface of longer slat (44)
53. gas spring cylinder ends (upper)
54. gas spring cylinders
55. sleeve element of lower hinge member
56. hinge pin
57. sleeve element of upper hinge member

The invention claimed is:

1. An environment-friendly coffin comprising a box assembly and a profiled lid assembly covering the box assembly, said assemblies being connected to each other by means of connecting elements, where said box assembly is equipped with feet fastened to a bottom of the box assembly and grip handles attached to both longer sides of said box assembly, characterised in that the box assembly (1) comprises a casing (3) made of natural stone plate, plate-shaped flats (10) with tapped bores (11) made in the flats, fixed to inner or outer surfaces of longer plate-shaped inner side walls (5) of said casing, plate-shaped metal washers (12) with tapped mounting bores (13), fixed to the inner side walls (5), and a tubular rectangular element (15) mounted inside the casing (3), said tubular element being made of glass fibre mat or a metal, fixed to inner surfaces of said plate-shaped side walls (5) and to a plate bottom (4) made of natural stone slab or made of natural stone slab and plate (27) made of a wood-base material fixed to said slab by means of glue-based sealing mass (17), whereas the profiled lid assembly (2) of the coffin has an outer casing made of natural stone in the form of a block with a bottom cascade-shaped cavity (23) or trough-shaped cavity (32) with a profile of a truncated pyramid, with a lower side offset in the form of a slab frame (29), whereas to an inner surface of the outer casing there is an insert made of a wood-base material (30) with the same profile of the truncated pyramid attached by means of a glue to which a glass fibre mat (31) is glued.

2. The environment-friendly coffin according to claim 1 characterised in that inside the box assembly (1) are mounted flat-bar U-shaped stirrups (14) made of glass fibre, wherein vertical elements of the stirrups (14) fit tight to said flats (10) and to said metal washers (12), wherein said tubular element (15) is placed in said stirrups.

3. The environment-friendly coffin according to claim 1 characterised in that to the bottom made of natural stone of the box assembly (1), angle-section shaped feet (7) made of natural stone are fastened in corners of the bottom of the box assembly (1), and T-shaped feet (8) made of natural stone are fastened opposite each other at half of the length of the coffin.

4. The environment-friendly coffin according to claim 1 characterised in that the inner surface of the tubular rectangular element (15) is provided additionally with two horizontally oriented slat rectangular frames (33) and (34) fastened to said inner surface, of which one frame is situated on the perimeter of the upper end of said element so that its upper face (35) is flush with an upper face (36) of cuboidal element and with upper face (37) of said box (1), and the second slat rectangular frame (34) is situated on the perimeter of the lower end of the tubular element (15) so that a lower face (38) of the tubular element is flush with a lower face (39) of said tubular element which together fit tight to the plate bottom (4) of the box assembly (1), where both of the two slat rectangular frames (33) and (34) are topped with each other in corners by means of vertically oriented slat angle-section shaped elements (40) fitting tight also to walls of the tubular rectangular element (15), whereas each of both of longer lower opposite slats (41) and (42) of the slat frame (34) is provided with three angle-section shaped elements (43) evenly distributed along the length of the slats fastened to the plate bottom (4) and to said slats, whereas fastened to the upper face (35) of one longer slat (44) of the slat rectangular frame (33) are horizontal members (45) of angle hinges (46), wherein upper revolving members (47) of the angle hinges (46) are fastened to an inner side surface of said lid (2) of the box (1) via plate-shaped rectangular elements (48) fastened to said lid, and moreover three sets of gas springs (49) are fastened to a side surface of the longer slat (44) and to said rectangular elements, where ends (50) of piston rods (51) of said gas springs are fastened to side surface (52) of said one longer slat (44), and ends (53) of cylinders (54) of said gas springs are attached to said plate-shaped rectangular elements (48).

5. The environment-friendly coffin according to claim 4 characterised in that the angle hinge (46) comprises a rectangular lower horizontal element (45) at the end of which a sleeve element (55) with a pin (56) is mounted, and an angle upper element (47) ended at a bottom also with a sleeve element (57) which is mounted rotationally on the pin (56) of the lower element (45).

6. The environment-friendly coffin according to claim 4 characterised in that said box assembly (1) with said bottom (4) and said lid assembly (2), as well as said slat rectangular frames (33) and (34) topped with each other by means of the angle-section shaped elements (40) of said tubular rectangular element (15) are all made of a hard material.

* * * * *